US011591908B2

(12) United States Patent
Jordan

(10) Patent No.: US 11,591,908 B2
(45) Date of Patent: Feb. 28, 2023

(54) METHOD AND SYSTEM OF CONSTRUCTING AN UNDERGROUND TUNNEL

(71) Applicant: hyperTunnel IP Limited, Basingstoke (GB)

(72) Inventor: Stephen Jordan, Basingstoke (GB)

(73) Assignee: hyperTunnel IP Limited, Basingstoke (GB)

( * ) Notice: Subject to any disclaimer, the term of this patent is extended or adjusted under 35 U.S.C. 154(b) by 0 days.

(21) Appl. No.: 17/480,650

(22) Filed: Sep. 21, 2021

(65) Prior Publication Data

US 2022/0003115 A1 Jan. 6, 2022

Related U.S. Application Data

(63) Continuation of application No. PCT/GB2020/050756, filed on Mar. 20, 2020.

(30) Foreign Application Priority Data

Mar. 22, 2019 (GB) ..... 1903979

(51) Int. Cl.
*E21D 9/00* (2006.01)
*E21D 9/06* (2006.01)

(52) U.S. Cl.
CPC ..... *E21D 9/001* (2013.01); *E21D 9/03* (2016.01); *E21D 9/06* (2013.01)

(58) Field of Classification Search
CPC ..... E21D 9/001; E21D 9/002; E21D 9/03; E21D 9/06
See application file for complete search history.

(56) References Cited

U.S. PATENT DOCUMENTS 528,367 A * 10/1894 Harris
3,299,643 A * 1/1967 Mauclet ..... E21D 9/001 166/57

(Continued)

FOREIGN PATENT DOCUMENTS

CN 105822316 A 8/2016
CN 106089174 11/2016

(Continued)

OTHER PUBLICATIONS

EPO, Extended European Search Report in Corresponding EP Application 22155907.3, dated May 31, 2022.

(Continued)

*Primary Examiner* — Janine M Kreck
(74) *Attorney, Agent, or Firm* — Ryan Alley IP

(57) ABSTRACT

Long tunnels of many kilometres are likely to pass through a range of geologies which may cause problems. The present invention seeks to overcome the disadvantages of the prior art by: drilling a first bore 10 along a first predetermined path, the first bore having a length of at least 25 m; drilling a plurality of second bores 20 along respective second predetermined paths, each substantially parallel to the first predetermined path in order to define a substantially prism-shape region therebetween; and excavating material within the substantially prism-shape region to form a tunnel. In this way, data from drilling the first bore 10 and the plurality of second bores 20 can be recorded and used to inform operators as to the types of material through which they will be excavating. Thus, a more complete view of the underlying geology can be achieved before beginning excavations.

5 Claims, 10 Drawing Sheets

(56) References Cited

U.S. PATENT DOCUMENTS

| | | | | | |
|---|---|---|---|---|---|
| 3,943,722 | A * | 3/1976 | Ross | E21D 9/001 165/45 |
| 4,017,121 | A * | 4/1977 | Trent | E21D 9/001 166/308.1 |
| 5,505,558 | A | 4/1996 | Brown | |
| 6,520,718 | B1 * | 2/2003 | Nagatomo | E21D 9/00 405/266 |

FOREIGN PATENT DOCUMENTS

| | | | | |
|---|---|---|---|---|
| EP | 3942154 | B1 * | 8/2022 | E21B 7/025 |
| JP | S62273392 | | 11/1987 | |
| JP | H04-106293 | A | 4/1992 | |
| JP | H07-042483 | A | 2/1995 | |
| JP | H07-301095 | A | 11/1995 | |
| JP | H08-035391 | A | 2/1996 | |
| JP | H11-280093 | A | 10/1999 | |
| JP | 2006-097409 | A | 4/2006 | |
| JP | 2013-199822 | A | 10/2013 | |
| JP | 2014-185514 | A | 10/2014 | |

OTHER PUBLICATIONS

WIPO, International Search Report in corresponding PCT application PCT/GB2020/050756, dated Aug. 3, 2020.
WIPO, Written Opinion in corresponding PCT application PCT/GB2020/050756, dated Aug. 3, 2020.
JPO, machine translation of office action in corresponding JP Application 2021-559457, dated May 9, 2022.

* cited by examiner

METHOD AND SYSTEM OF CONSTRUCTING AN UNDERGROUND TUNNEL

RELATED APPLICATIONS

This application claims priority under 35 U.S.C. § 120 to, and is a continuation of, co-pending International Application PCT/GB2020/050756, filed Mar. 20, 2020 and designating the US, which claims priority to GB Application 1903979.1, filed Mar. 22, 2019 such GB Application also being claimed priority to under 35 U.S.C. § 119. These GB and International applications are incorporated by reference herein in their entireties.

FIELD

The present invention relates generally to a method and system of constructing an underground tunnel and finds particular, although not exclusive, utility in construction of tunnels of many kilometres in length.

BACKGROUND

In addition to cost and speed, the main challenges when building a tunnel stem from the geology that will be encountered. In relatively short tunnels the geology might be quite consistent and easy to plan for. However, long tunnels of many kilometres are likely to pass through a range of geologies causing significant and even potentially catastrophic problems. Ideally, a tunnel would be constructed through favourable and/or consistent geology for its entire length. However, conventional methods involve merely sampling the geology along a proposed tunnel's length from above (where possible) and extrapolating from those samples.

Tunnel Boring Machines (TBMs) are known that comprise a large metal cylindrical shield fronted by a rotating cutting wheel and containing a chamber where the excavated soil is deposited (and optionally mixed with slurry for extraction, depending on the type of geological/soil conditions). Behind the chamber there is a set of hydraulic jacks that are used to push the TBM forward relative to the concrete tunnel wall behind. The tunnel wall is installed in segments as the TBM moves forward. Once the TBM has excavated the length of a segment, it stops and a new tunnel ring is built by an erector utilising the precast concrete segments. Further operational mechanisms can be found behind the shield, inside the finished part of the tunnel, which are typically considered part of the TBM system: dirt removal, slurry pipelines if applicable, control rooms, rails for transport of the precast segments, etc. However, TBMs have various disadvantages including the stop-start nature of their tunnelling, and that a single TBM cannot easily transition between different rock/soil types (especially heavily fractured and sheared rock layers).

In addition, various Directional Boring techniques as used in the mining, oil and gas, and construction industries. For example, Horizontal Directional Drilling (HDD) is used for installing pipes, etc. HDD is capable of boring suitably accurate holes up to only ~800 m long with diameters only between 100 mm and 1200 mm. Alternatively, directional drilling is used in the oil & gas industry, and enables much longer holes to be bored.

SUMMARY

The present invention seeks to overcome the disadvantages of the prior art by providing a system and method as described below. The present invention may be used in the construction of new tunnels, as well as in the process of enlarging and/or relining and/or repairing existing tunnels.

According to a first aspect of the present invention, there is provided a method of constructing an underground tunnel, the method comprising the steps of: drilling a first bore along a first predetermined path through underlying geology, the first bore having a length of at least 25 m; drilling a plurality of second bores along respective second predetermined paths through the underlying geology, each of the respective second predetermined paths being substantially parallel to the first predetermined path in order to define a substantially prism-shape region therebetween; and excavating material within the substantially prism-shape region to form a tunnel.

In this way, data from drilling the first bore and the plurality of second bores can be recorded and used to inform operators as to the types of material through which they will be excavating. Thus, a more complete view of the underlying geology can be achieved before beginning excavations.

Drilling may comprise directional boring, for example HDD or forms of directional drilling used in the oil & gas industry.

Drilling operations may be carried out from a preconstructed tunnel entrance and/or exit, an intermediately-located shaft and/or from the surface.

Each bore of the first bore and/or plurality of second bores may comprise a hole and/or shaft that is substantially circular in cross section and has a length orders of magnitude greater than its diameter. For example, each bore may have a diameter of between 100 mm and 1200 mm; each bore may have a length of at least 25 m, at least 50 m, at least 100 m, at least 200 m or more.

The method may comprise determining the first predetermined path (and optionally the second predetermined paths); however, this is to be done by conventional methods.

The substantially prism-shape region may be defined by the plurality of second bores alone, or may be defined by a combination of the plurality of second bores and the first bore together. For example, the first bore in combination with two second bores may form a triangular prism-shape region. As another example, three second bores may form a triangular prism-shape region alone, with the first bore being located within the triangular prism-shape region; alternatively, the three second bores together with the first bore may form a cuboidal (square prism-shape) region, if appropriately placed relative to one another.

The prism shape region may curve; that is, the region may have a cross-section of a geometric shape (e.g. triangle, square, etc.), regular or otherwise, along its entire length (and that geometric shape, and the size of that shape may be constant along its length), however, the path upon which the region is based may not be a straight line, but may be a curved line.

The first bore may comprise a single first bore or a plurality of first bores (e.g. two or three first bores). The first bore may comprise a lead bore. The lead bore may be spaced from a perimeter of the prism-shape region, being located through an inner portion of the prism-shape region.

Data from the first bore may be collected to determine the material through which drilling has been performed.

The plurality of second bores may form a tunnel profile; that is, the plurality of second paths may project along the walls of the proposed tunnel.

The cross-section of the tunnel may be circular; however, other cross-sections are possible, such as rectangular, semi-circular, arched, flat bottomed, etc. Circular or curved walls may improve stability of the tunnel structure so formed, but where this is deemed unnecessary (for example from the data acquired from the first/second bores) a flat floor may be chosen to facilitate easy movement of people, excavation equipment, and muck carts.

The first and/or second bores may be lined, for instance with (e.g. sacrificial) pipe or liner. In this way, the integrity of each bore may be protected. The first bore may be lined before/after drilling of the plurality of second bores is started and/or completed. Similarly, at least one of the second bores may be lined before/after drilling of the first bore is started and/or completed. Lining may comprise lining the whole bore, or only a portion of the bore. Any bore lining may be removed or partially removed prior to excavating.

All, or some, of the first and second bores may be drilled at the same time, or each bore may be drilled individually. This may be particularly important when drilling through sand/soil where the integrity of each bore is at risk.

Excavating material within the substantially prism-shape region to form a tunnel may be carried out from a tunnelling shield, the tunnelling shield comprising a plurality of probes on a leading edge thereof, each probe of the plurality of probes aligned with a respective bore of the first bore and plurality of second bores.

The shape of the shield matches the profile of the tunnel; that is, the cross-section of the region to be excavated. The probes may be sized to fit within the first and/or second bores; in particular, the probes may be sized such that some variation of the location of each bore from its predetermined path is permitted, for example up to 50 cm, more particularly up to 30 cm.

Stretches where deviation outside the tolerance has occurred may be addressed by temporarily retracting/removing a relevant probe (until such time as it can be reengaged), and excavating by alternative means (e.g. boom-mounted cutting heads as found on roadheader units).

The probes may be equipped with (optionally interchangeable) tools that allow them to excavate from within the first and/or second bores. In particular, various different tools may be employed for use with different materials, for example disc cutters, rotating cutter cylinders or cones, chainsaw type arms with teeth suitable to the material being worked on, high pressure water, plough blades, and hydraulic splitters that can apply enormous pressure directed as required both around the circumference of the tunnel and inwards to further loosen and break up the material to be removed.

The probes may be retractable so that they can be removed or tools changed without requiring movement of the shield.

Collapsing/slumping techniques can be used on soft and/or loose material to be excavated. For this type of work the probes are fitted with plough blades as the shield advances.

As the shield advances a laser array may be used to constantly scan newly exposed outer surface of the excavation to ensure that no material has been left protruding into the tunnel from the peripheral wall such that it would foul or impede the progress of the shield. Ground penetrating radar may also be used where spoil covers areas of the newly exposed tunnel.

The method may further comprise removing such areas when detected, for example by using a robotic arm(s) mounted with a pneumatic drill or interchangeable cutting head or other suitable tool.

Directional boring/drilling technology may be combined with the shield technology such that the drilling is performed in front of each probe on the shield, thereby permitting the shield to advance before drilling has been completed.

The shield may have a sloping leading edge, the angle of which can be chosen by conventional methods based on the nature of the material to be excavated. In particular, the sloping leading edge slopes up and toward the tunnel to be excavated.

The shield may be pushed by hydraulic rams.

The shield may comprise a dragline shield, and the method may further comprise pulling the dragline shield through the material. A dragline shield may be a combination of tunnelling shield and dragline excavator technology. A dragline excavator may comprise a dragline bucket suspended from a boom so that it can be positioned by the boom. Cables/ropes/chains (typically controlled by a winches) are used to drag the bucket, thereby scooping material to be excavated into the bucket. The dragline shield is similarly dragged by cables controlled by winches (which would be run through the first and/or second bores), but a positioning boom is not required as the dragline shield sits within the tunnel and positioning is unnecessary.

The dragline shield may be pulled through the material by a plurality of cables, each cable of the plurality of cables passing through a respective bore of the first bore and plurality of second bores.

In this way, progress of the shield may be reliable and continuous. Each cable may be attached to a respective probe. A winch or winches may act on a respective cable of the plurality of cables, or more than one cable of the plurality of cables in order to pull the shield forward. The winches may be provided at an opposing end (e.g. open end) of the bores.

Each cable of the plurality of cables may pass down through its respective bore of the first bore and plurality of second bores to a cable return carriage secured down-hole, and passes back up through the respective bore to the dragline shield.

In this way, the winches may be provided behind or within the shield, and may enable operation of the shield before each bore is completed.

The cable return carriage may comprise a clamping system that engages with the walls of the bores into which it is placed. The clamping system may be remotely operable to engage and disengage on command, such that it can be moved to a new location when required.

Spoil may be removed continuously, for instance with a mechanical excavator, onto a loading mechanism. However, in preferred embodiments, the shield is shaped such that movement of the shield forward through the excavated tunnel lifts spoil from the excavation onto the loading mechanism. In particular, the action of lifting the spoil is similar to that of a bulldozer or dragline bucket.

Spoil removal from the shield is by conventional methods; it having been conveyed back to where the tunnel floor is able to take heavy machinery. The heavy machinery may comprise zero emission autonomous electric or hydrogen powered haulage vehicles. These vehicles may bring materials, e.g. pre-cast lining segments if being used, to the working area as well as taking spoil away. The vehicles may be configured to return automatically to a charge point when required before resuming operations.

The lowermost bores (e.g. along the floor of the tunnel) may be swept clean behind the point where the spoil enters the shield so that the shield's undercarriage (e.g. wheels/skids) may run in the rough half-pipes that are left in place from the sacrificial liner. In this way, no rails need be installed or extended as the shield advances.

Any one or each bore may be lined with a liner. The liner may comprise a sacrificial liner. The liner may comprise a solid wall. Alternatively, the liner may be pre-perforated; in this way, time and cost on site may be avoided in situations in which the underlying geology is well understood. The pre-perforated liner may comprise an outer sleeve that covers the perforations; in this way, material or water may be prevented from entering the bore in an uncontrolled manner.

Equipment may be passed through the liner in a conventional manner to perform operations at a desired location. The equipment may comprise the return carriage, drill head, and/or a perforating gun. In particular, a perforating gun (as conventionally used in the hydraulic fracturing industry) may be passed through the liner to perforate the liner in a desired location. The perforating gun may comprise a plurality of shaped explosive charges. The perforating gun may be configured to weaken material beyond the liner; i.e. the explosives may act to fracture the material. The perforations may be formed in desired locations on the liner, for example facing inward toward the prism-shape region, facing outward away from the prism-shape region, and/or laterally along a profile of the prism-shape region.

The method may further comprise the step of treating the underlying geology in advance of excavating the material in order to increase efficiency of excavating the material.

Treating may comprise acoustic and/or hydraulic fracturing of the material within the substantially prism-shape region.

In cases where the material within the region is relatively hard, pressurised water may be introduced, for instance via the perforations, causing the material to fracture. Unlike in fracking operations to remove natural gas or oil, it is unnecessary to introduce small grains of hydraulic fracturing proppants (either sand or aluminium oxide) to hold the fractures open.

Application of acoustic and/or hydraulic fracturing techniques via the perforations permit the fracturing to occur in specific pre-defined directions only; for example, into the region.

Ahead of the shield, reaming tools may be passed through the bore(s) to destroy the sacrificial lining allowing the material for excavation to collapse/slump thereby aiding the removal process.

Treating may comprise stabilising the underlying geology outside the substantially prism-shape region.

In this way, in cases where the material outside the region is relatively weak, contains voids, is unstable, or waterlogged, the material can be stabilised. Equipment may be placed down-bore to stabilise the underlying geology.

Stabilisation may be via ground freezing techniques, for instance by coolant pumped through the liner and potentially exiting the liner through perforations. Freezing techniques may be temporary.

As an alternative, permanent stabilisation may be achieved by injecting chemical stabiliser, for instance via chemical delivery nozzles (e.g. within telescopic arms). The amount and type of stabiliser used will be determined by the geology to be stabilised and can be controlled as required, and may comprise cement or any other suitable material such as microcements, mineral grouts (known as colloidal silica), water sensitive polyurethanes (rapid reacting foaming resin to combat water ingress), quick reacting and non-water sensitive polyurea silicate systems (expanding foam for void filling), acrylic resins, jet grouting viz. the in situ construction of solidified ground to a designed characteristic; often known as Soilcrete (RTM), etc.

Stabilisation of the underlying geology outside the substantially prism-shape region may greatly reduce, if not completely prevent, further water ingress. Any ground water remaining within the confines of the tunnel to be excavated can be drained via the lowermost of the bores.

Stabilisation or weakening as described above can be synchronised with the shield such that ground preparation need not be fully completed before commencing shield advancement.

Stabilisation of the underlying geology outside the substantially prism-shape region can be used to form the initial outer structure (shell) of the tunnel ahead of excavation.

Alternative and/or additional tunnel lining options include precast concrete segments (with or without waterproof linings), cast-in-place concrete (involving modular shutter design formwork using rebar, for example), and/or spray concrete, e.g. "shotcrete" (with or without spray applied waterproof membranes, and optionally incorporating roof bolting, wire mesh, or steel ribs/rebar).

Conceivably, the present invention could also be used with tunnel linings of timber, brickwork, blockwork, masonry, pipe in tunnel method and/or cast steel/iron segments.

For example, formation of the tunnel lining may comprise a spray applied waterproof membrane (for example, BASF's (RTM) spray applied waterproofing membranes make up a continuous waterproofing system and are formulated to work in combination with sprayed concrete and in-situ concrete to facilitate the construction of composite structures) and an internal finishing spray of fibre reinforced concrete. Alternatively, where the geology requires greater structural integrity, cast-in-place methodology may be preferred.

The method may further comprise a continuous concrete forming process. In particular, as the shield drives forward, the last in the series of sequenced reusable metal formers may be moved forward, older concrete having set, and positioned at the front where the pouring will continue in a near non-stop process. Water and cement may be brought into the working area and the concrete may be mixed locally to the excavation operation using excavated aggregate wherever possible. It is expected that the formers will be approximately 10 m in length, in 3 or 4 pieces per section set and with 10 or more of the segment sets in use. This would mean that ~90 m of the tunnel behind the shield will have formers in place with newly poured concrete at the front and set concrete at the back where the former segment sets are removed and taken forward to the front in a continuous cycle. The formers can pass each other so that the units where the concrete is the oldest and has set can be moved forwards to be redeployed at the front of the process. The seal between the former and the surface where the concrete is to be poured may be made with pneumatic gaskets. Once the latest form has been placed and the gasket inflated the previous gasket will be deflated so that the pour remains continuous. The process may be simply repeated.

Spoil from the directional boring and excavating may be used to make concrete that can be pumped into the space between the tunnel skin (if a prefabricated liner is used) and the shell to fill the void therebetween and to further stabilise the structure. Alternatively or additionally, such spoil (e.g. rock chippings) may be used as part of the aggregate required to make concrete on site for forming the tunnel lining using movable and reusable forms or other lining methods such as sprayed concrete.

A flat floor may be poured in a continuous process as the shield moves forward with a metal plate or structure protecting the concrete as it sets. The shield may utilise some of the directionally drilled bores in the floor of the tunnel as tracks or rails (the number required determined by the shield design). These can be filled in or repurposed once all tunnelling has ceased and the shield has been removed.

According to a second aspect of the present invention, there is provided a method of constructing an underground tunnel, the method comprising the steps of: drilling a first bore along a first predetermined path through underlying geology; drilling a plurality of second bores along respective second predetermined paths through the underlying geology, each of the respective second predetermined paths being substantially parallel to the first predetermined path in order to define a substantially prism-shape region therebetween; lining the first bore and/or at least one of the plurality of second bores with a pipe and/or liner; and excavating material within the substantially prism-shape region to form a tunnel. In this way, the integrity of each bore may be protected.

The first bore and/or the plurality of second bores may be lined with (e.g. sacrificial) pipe or liner. The pipe and/or liner may comprise a plastics material, as is well understood in the art.

The first bore may have a length of at least 25 m, or less than 25 m. For example, the first bore may have a length of at least 5 m, 10 m, 15 m and/or 20 m. However, other features of the second aspect may be common with the first aspect.

According to a third aspect of the present invention, there is provided a system for constructing an underground tunnel according to the method of the first aspect or the second aspect, the system comprising: directional drilling equipment configured to drill the first bore and the plurality of second bores; and excavation equipment configured to excavate the material within the substantially prism-shape region defined by the first bore and the plurality of second bores to form a tunnel.

BRIEF DESCRIPTION OF THE DRAWINGS

The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

DETAILED DESCRIPTION

Figure 1:
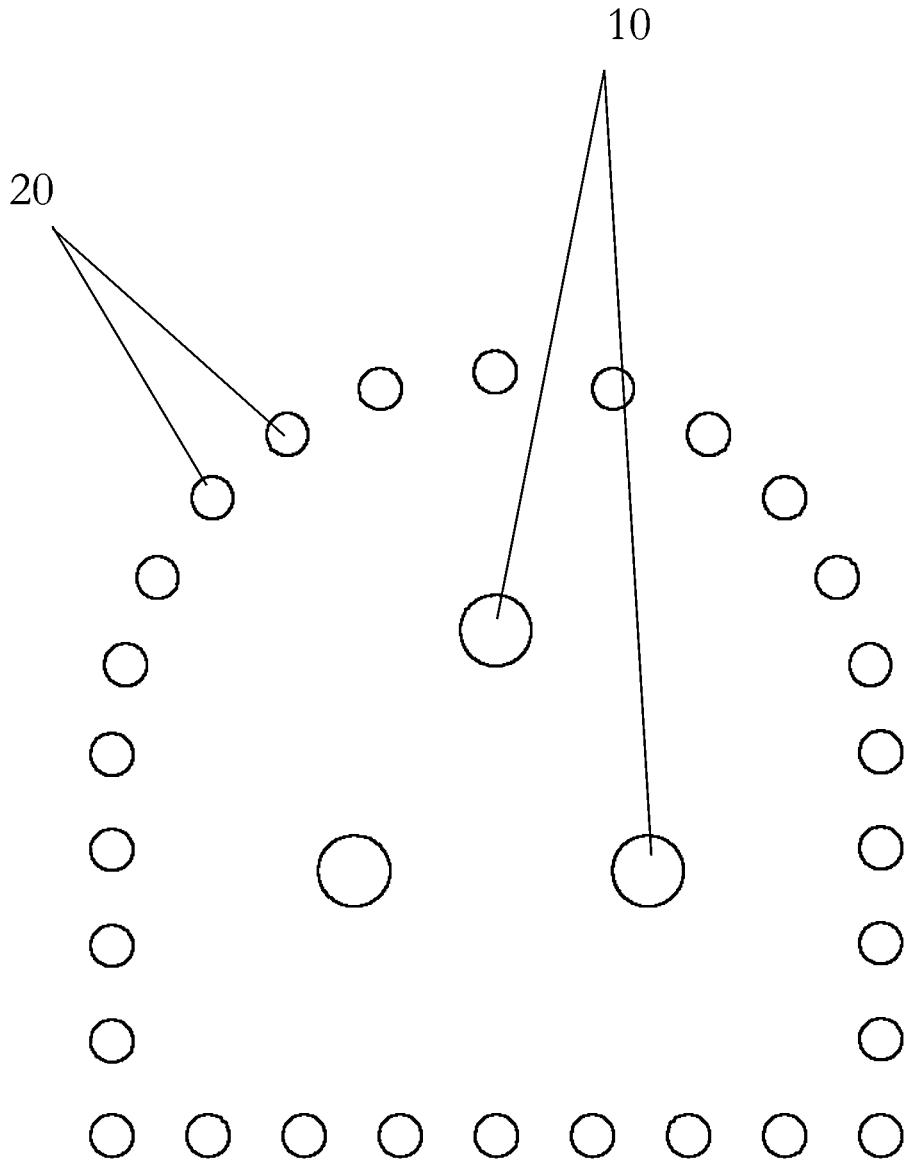
FIG. 1 is a view of a tunnel profile defined by circular bores.

The present invention will be described with respect to certain drawings but the invention is not limited thereto but only by the claims. The drawings described are only schematic and are non-limiting. Each drawing may not include all of the features of the invention and therefore should not necessarily be considered to be an embodiment of the invention. In the drawings, the size of some of the elements may be exaggerated and not drawn to scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequence, either temporally, spatially, in ranking or in any other manner. It is to be understood that the terms so used are interchangeable under appropriate circumstances and that operation is capable in other sequences than described or illustrated herein. Likewise, method steps described or claimed in a particular sequence may be understood to operate in a different sequence.

Moreover, the terms top, bottom, over, under and the like in the description and the claims are used for descriptive purposes and not necessarily for describing relative positions. It is to be understood that the terms so used are interchangeable under appropriate circumstances and that operation is capable in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Similarly, it is to be noticed that the term "connected", used in the description, should not be interpreted as being restricted to direct connections only. Thus, the scope of the expression "a device A connected to a device B" should not be limited to devices or systems wherein an output of device A is directly connected to an input of device B. It means that there exists a path between an output of A and an input of B which may be a path including other devices or means. "Connected" may mean that two or more elements are either in direct physical or electrical contact, or that two or more elements are not in direct contact with each other but yet still co-operate or interact with each other. For instance, wireless connectivity is contemplated.

Reference throughout this specification to "an embodiment" or "an aspect" means that a particular feature, structure or characteristic described in connection with the embodiment or aspect is included in at least one embodiment or aspect of the present invention. Thus, appearances of the phrases "in one embodiment", "in an embodiment", or "in an aspect" in various places throughout this specification are not necessarily all referring to the same embodiment or aspect, but may refer to different embodiments or aspects. Furthermore, the particular features, structures or characteristics of any one embodiment or aspect of the invention may be combined in any suitable manner with any other particular feature, structure or characteristic of another embodiment or aspect of the invention, as would be apparent to one of ordinary skill in the art from this disclosure, in one or more embodiments or aspects.

Similarly, it should be appreciated that in the description various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Moreover, the description of any individual drawing or aspect should not necessarily be considered to be an embodiment of the invention. Rather, as the following claims reflect, inventive aspects lie in fewer than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some features included in other embodiments, combinations of features of different embodiments are meant to be within the scope of the invention, and form yet further embodiments, as will be understood by those skilled in the art. For example, in the following claims, any of the claimed embodiments can be used in any combination.

In the description provided herein, numerous specific details are set forth. However, it is understood that embodiments of the invention may be practised without these specific details. In other instances, well-known methods, structures and techniques have not been shown in detail in order not to obscure an understanding of this description.

In the discussion of the invention, unless stated to the contrary, the disclosure of alternative values for the upper or lower limit of the permitted range of a parameter, coupled with an indication that one of said values is more highly preferred than the other, is to be construed as an implied statement that each intermediate value of said parameter, lying between the more preferred and the less preferred of said alternatives, is itself preferred to said less preferred value and also to each value lying between said less preferred value and said intermediate value.

The use of the term "at least one" may mean only one in certain circumstances. The use of the term "any" may mean "all" and/or "each" in certain circumstances.

The principles of the invention will now be described by a detailed description of at least one drawing relating to exemplary features. It is clear that other arrangements can be configured according to the knowledge of persons skilled in the art without departing from the underlying concept or technical teaching, the invention being limited only by the terms of the appended claims.

FIG. 1 is a view of a tunnel profile defined by circular bores. Three central lead bores 10 are drilled along the path of the tunnel. Around these, a plurality of shape-defining bores 20 are drilled to form an arch-shape tunnel profile having a flat lower floor. The angle of slope of the tunnel is optimised to the specific requirements of the tunnel in question, and could for example be vertical.

Figure 2:
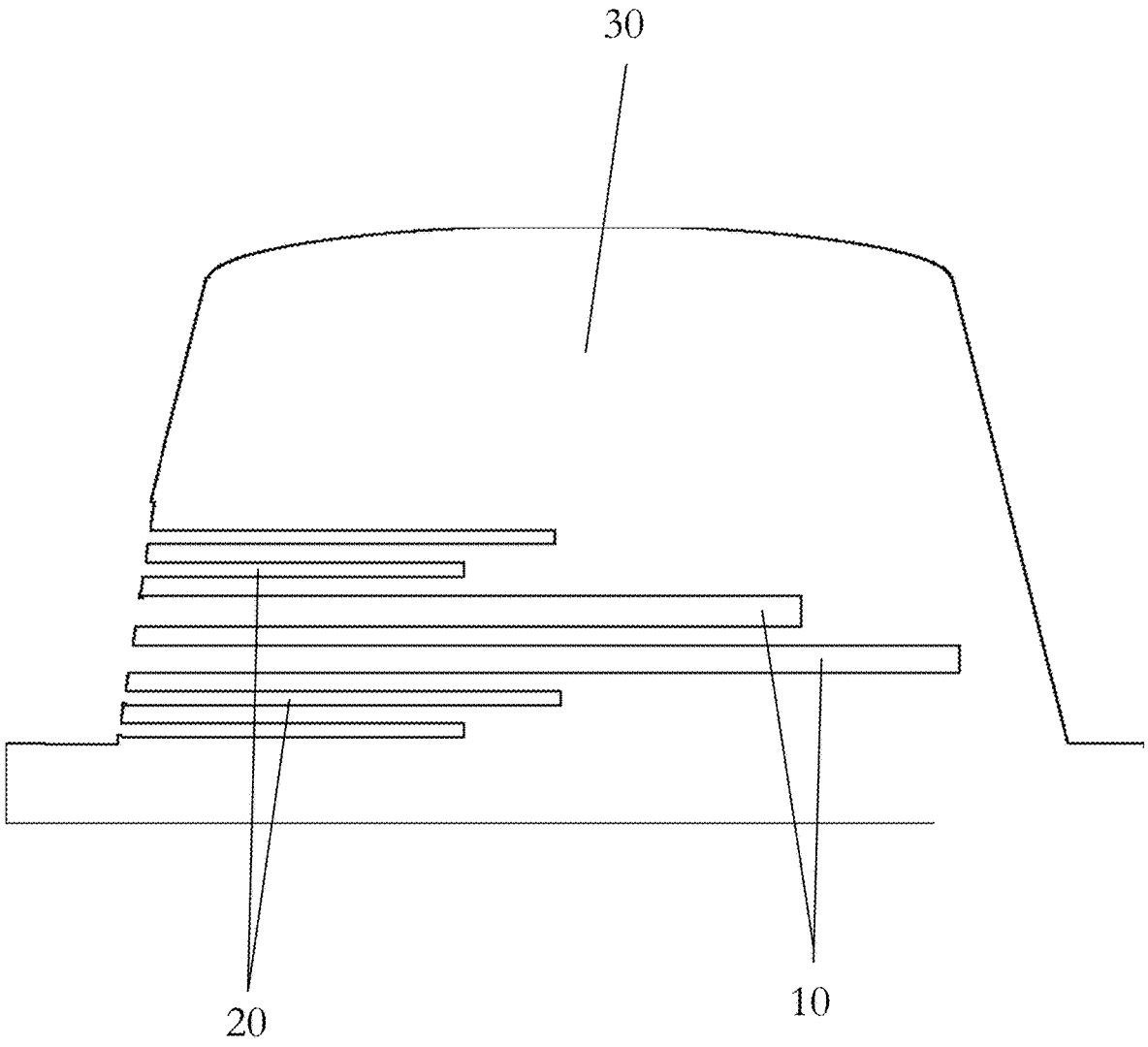
FIG. 2 is a side view of bores drilled into a hillside.

FIG. 2 is a side view of the lead bores 10 and shape-defining bores 20 during drilling into a hillside 30, the length of each of the bores 10, 20 being shorter than their final lengths. As can be appreciated, some of the bores may be drilled at the same time as others, some may be completed before others are started, and/or some may be partially drilled and interrupted while others are continued.

Figure 3:
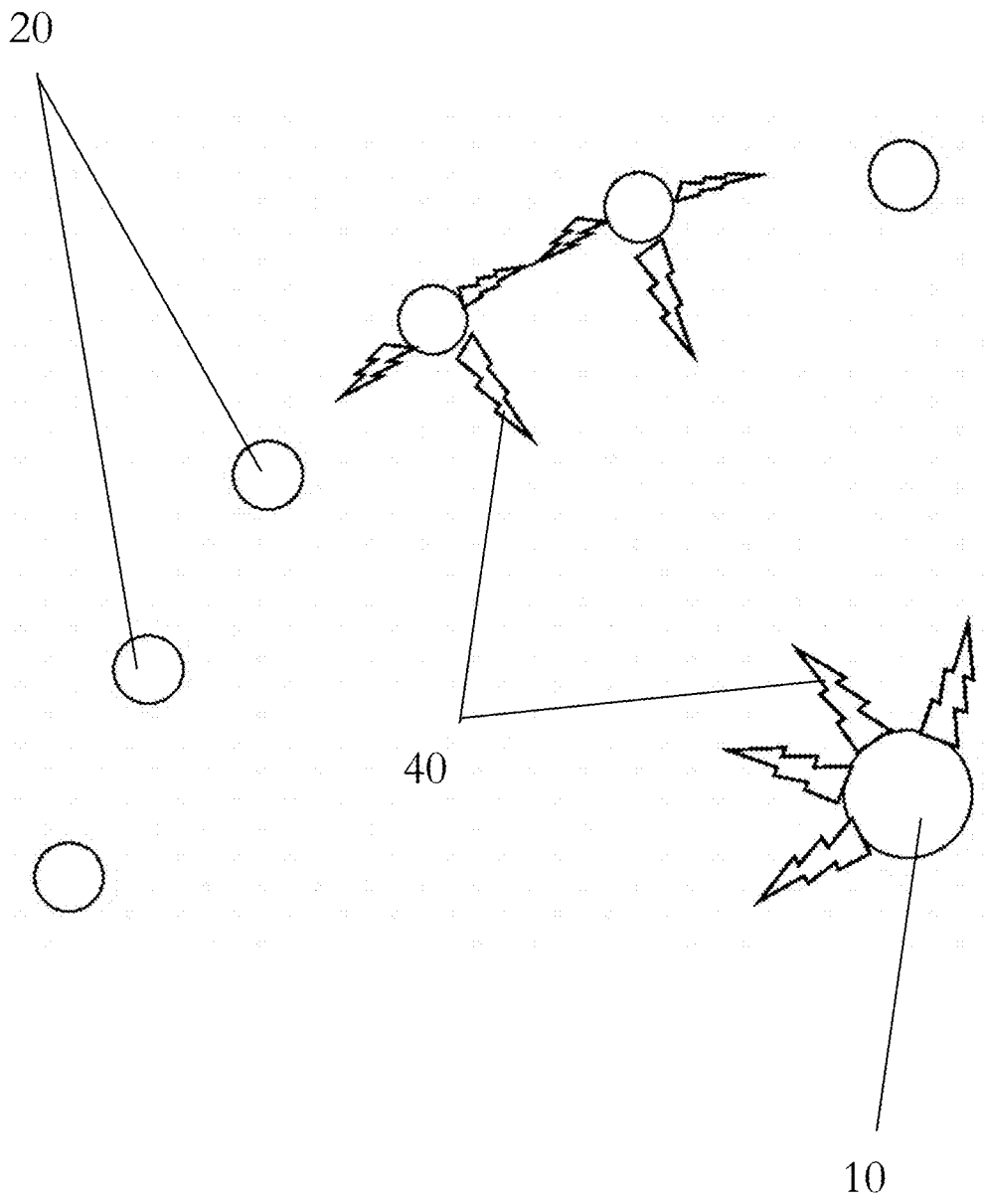
FIG. 3 is a view of a portion of the tunnel profile of FIG. 1 showing direction of explosions from a perforation gun.

FIG. 3 is a view of a portion of the tunnel profile of FIG. 1, specifically the top left quadrant including a single lead bore 10 and six of the shape-defining bores 20. The bores 10, 20 are lined with a sacrificial lining (not shown), into which are inserted respective perforation guns (also not shown). Perforation guns allow shaped charges to perforate the sacrificial linings in predetermined directions, leading to directed explosions 40. The explosions 40 shown here are directed inside the region to be excavated, and only from three of the bores; however, additional perforations may be formed concurrently, or subsequently. In alternative embodiments, the perforation guns may operate pneumatically to punch perforations in the sacrificial liner.

Figure 4:
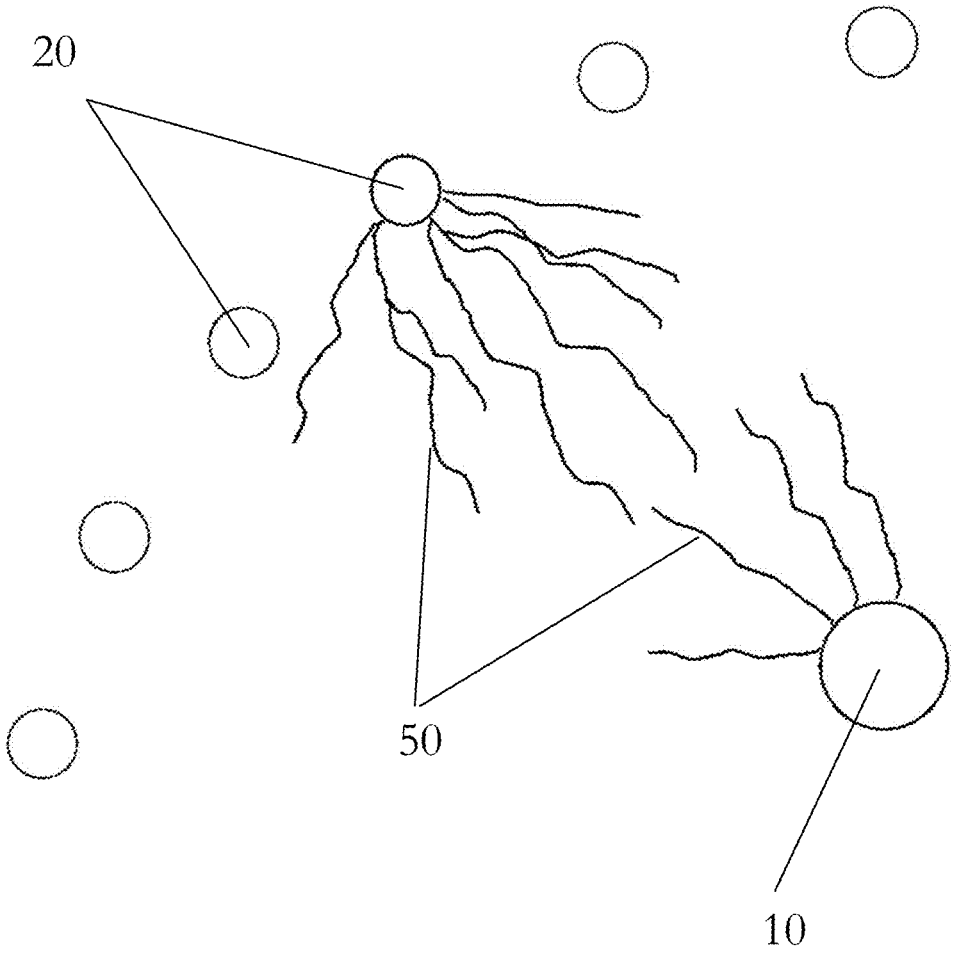
FIG. 4 is a similar view to FIG. 3, showing fractures formed by hydraulic fracturing.

FIG. 4 is a similar view to FIG. 3, showing fractures 50 formed by hydraulic fracturing through perforations similar to those shown in FIG. 3.

Figure 5:
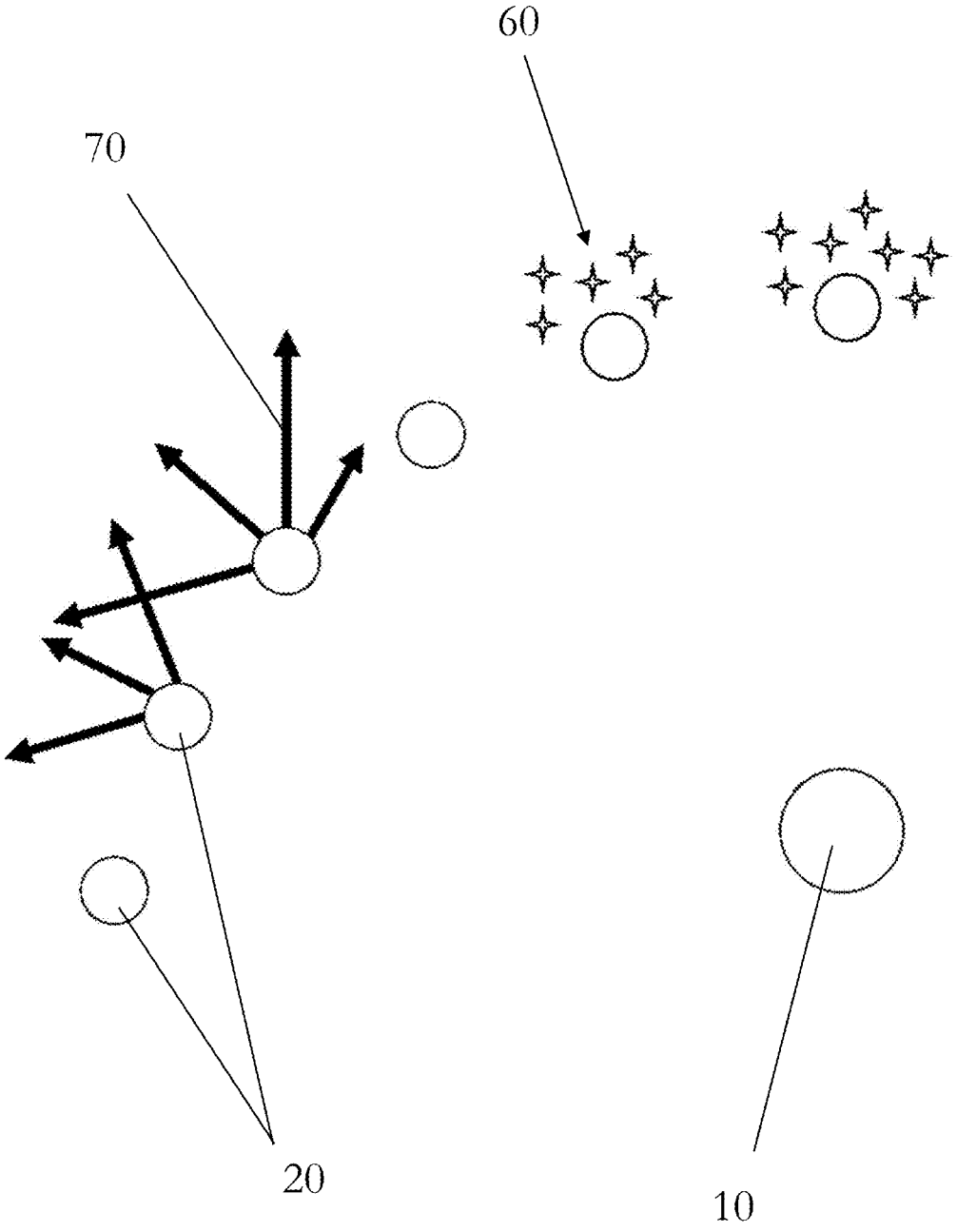
FIG. 5 is a similar view to FIGS. 3 & 4, showing various stabilisation techniques.

FIG. 5 is a similar view to FIGS. 3 & 4, showing stabilisation outside the region to be excavated via freezing 60 and via chemical injection 70. These techniques require the use of perforations directed outward, away from the region to be excavated.

Figure 6:
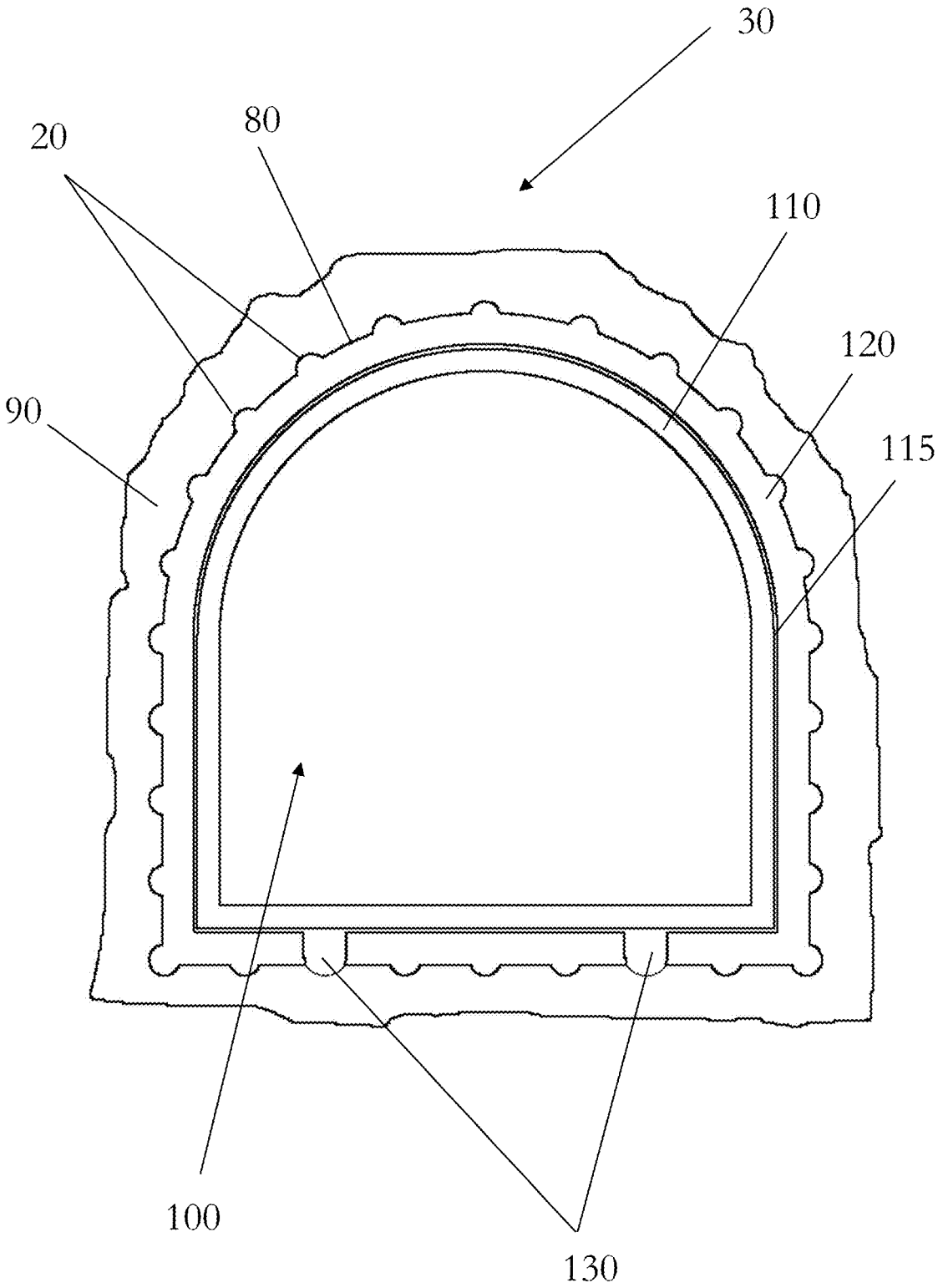
FIG. 6 is view of a completed tunnel profile, similar to FIG. 1.

FIG. 6 is a view of a completed tunnel 100 profile, similar to FIG. 1, in the hillside 30 of FIG. 2. Outside the profile 80 defined by the shape-defining bores 20 and excavated out, the underlying geology has been reinforced/stabilised to form a reinforced region 90 surrounding the tunnel. An example of the lining options that may be applied is depicted with an outer concrete lining 120 being separated from an inner concrete lining 110 by a waterproof membrane 115 if required.

Many other methods of tunnel lining and finishing are available. For example, temporary reusable metal formers may be placed within the tunnel and concrete 120 is applied behind the formers to form a smooth internal wall of the tunnel. Once the concrete 120 has fully hardened, the temporary formers may be removed and reused in another section of the tunnel, leaving the smooth concrete 120 as the internal wall.

Optionally, during excavation, two of the shape-defining bores 20 on the floor of the tunnel may be left to act as gullies/troughs 130 to help guide machinery (in particular the dragline shield) along the tunnel. These gullies/troughs 130 can be filled in at a later date, once the tunnel excavation is complete.

Figure 7:
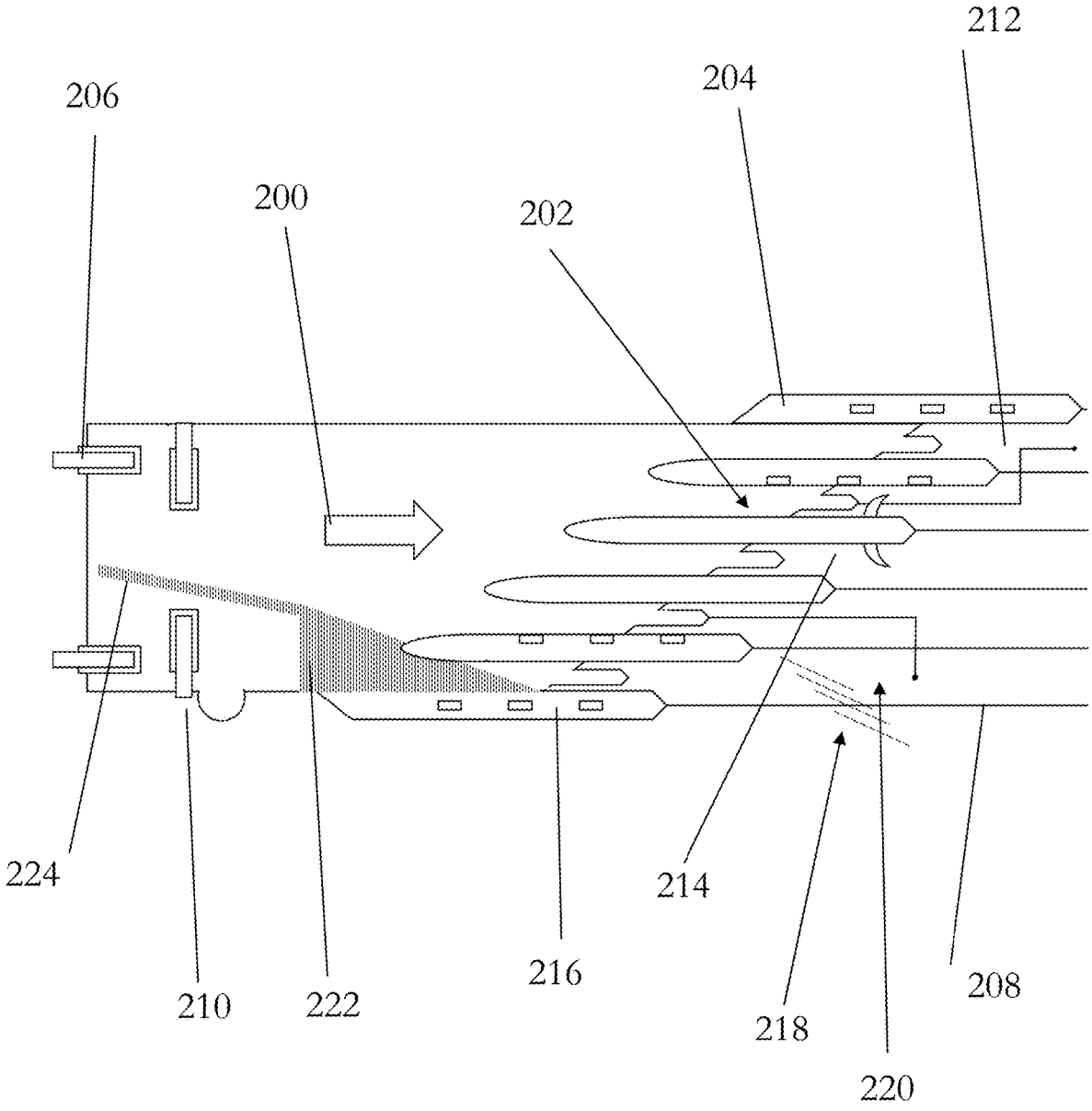
FIG. 7 is a side view of a dragline shield.

FIG. 7 is a side view of a dragline shield. Arrow 200 indicates the direction of motion of the dragline shield during excavation. The profile of the dragline shield matches the predefined outer tunnel shape. The angle of slope of the leading edge 202 of the shield is optimised to the specific requirements of the tunnel in question, and could for example be vertical.

Propulsion of the shield through the tunnel may be via hydraulic rams 206 that push the dragline shield and/or via cables 208 attached to the ends of the probes that run through the lined bores to winches that pull the dragline shield forward. The latter will be the preferred method as it facilitates continuous movement.

Lower shape-defining bores along the floor of the tunnel may be swept clean behind the point where the spoil enters the shield so that the wheels 210 (or alternatively undercarriage) of the dragline shield can then run in the rough half-pipes that are left in place from the sacrificial liner. No rails need be installed or extended as the dragline shield advances.

Probes 204 on the lead face of the shield align with and extend into the shape-defining bores. The probes 204 are spaced and sized such that they engage with the shape-defining bores and the dragline shield moves forward through the now predefined tunnel shape. While the accuracy of the bores is extremely precise, the probes 204 will be able to tolerate some variation should the path of the bore have deviated from the targeted course. Short stretches where deviation outside the tolerance has occurred could see the probe being retracted until such time as it can be reengaged following a period of excavation by other means such as boom-mounted cutting heads 212 as found on roadheader units.

The probes 204 are equipped with interchangeable tools that allow them to be as brutal or as sensitive as the situation dictates. These include but are not limited to disc cutters, rotating cutter cylinders or cones, chainsaw type arms with teeth suitable to the material being worked on, high pressure water, plough blades 214, and hydraulic splitters 216 that can apply enormous pressure directed as required both around the circumference/perimeter of the tunnel profile and/or inwards (toward the interior of the tunnel) to further loosen and break up the material to be removed (in addition to removing the sacrificial liner of the shape-defining bores).

Collapsing/slumping techniques can be used on soft and/or loose material to be excavated, in particular if the region outside the perimeter of the tunnel has been stabilised to form a self-supporting shell. For this type of work the probes are fitted with plough blades 214 as the dragline shield advances.

A laser array (not shown) will constantly scan 218 the newly exposed outer surface of the excavation to ensure that no material has been left protruding inwards such that it would foul or impede the progress of the dragline shield. Ground penetrating radar may also be used where spoil covers areas of the newly exposed tunnel. Should any such area be discovered it will be tackled immediately, without hindering progress, by one or more robotic arms 212 mounted with a pneumatic drill or interchangeable cutting head or other suitable tool.

Working under the protection of the dragline shield, the spoil is excavated continuously (assisted where required by a mechanical excavator 220) onto a loading mechanism 222 inside the shield. Loading onto the loading mechanism 222 may be primarily by the action of the dragline shield moving forward through the spoil much like a bulldozer. Spoil removal is by conventional methods; it having been moved rearwardly on a conveyor 224 back to where the newly laid tunnel floor is able to take heavy machinery.

Figure 8:
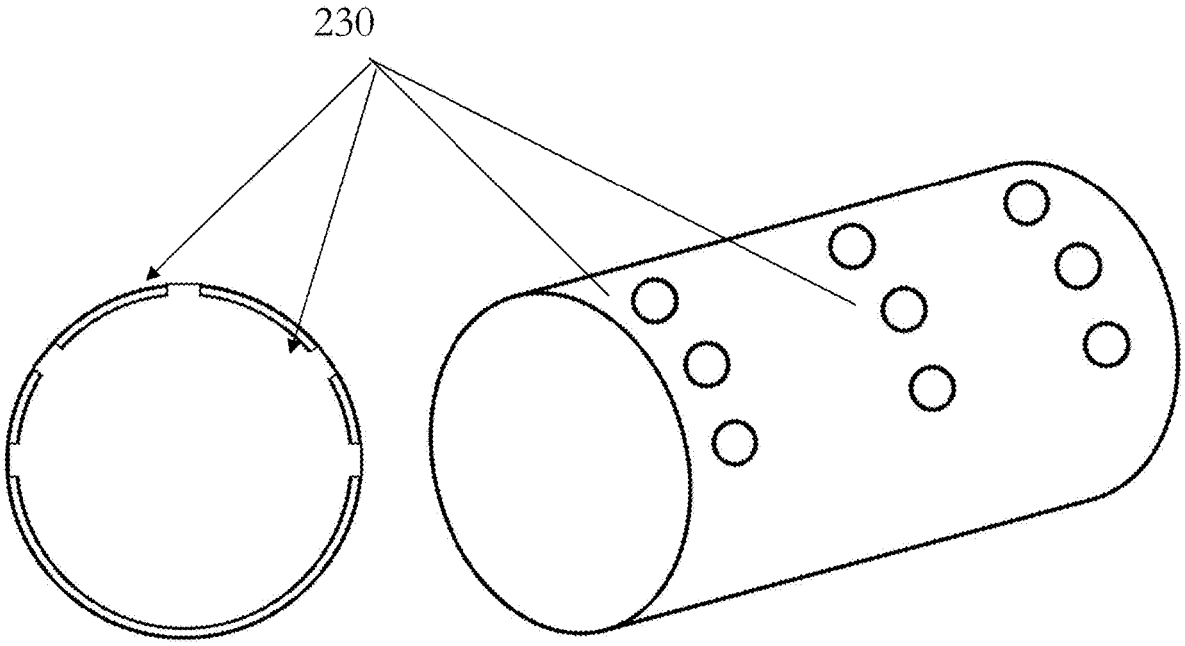
FIG. 8 is a view of a pre-perforated sacrificial liner for use within the bores.

FIG. 8 shows axial cross-sectional and oblique views of a pre-perforated sacrificial liner for use within the bores, the liner having a substantially cylindrical shape with an array of perforated holes 230 from an exterior to an interior thereof.

Figure 9:
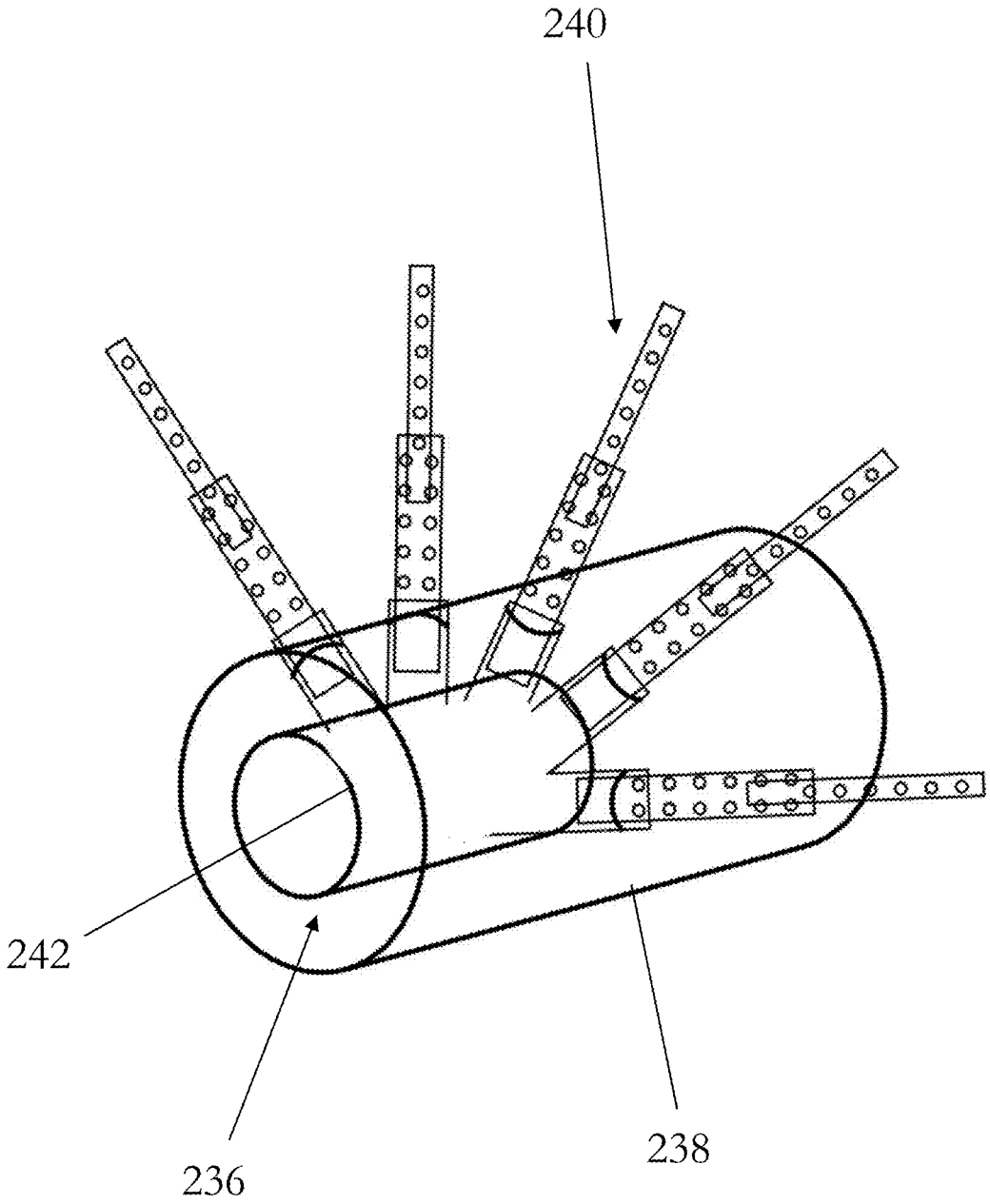
FIG. 9 is a view of a down hole telescopic chemical delivery carriage.

FIG. 9 is a view of a down hole telescopic chemical delivery carriage 236 configured to travel down an individual bore 238 to the area requiring chemical treatment. The carriage comprises 5 telescopic delivery probes 240 arranged around a carriage body 242, although other numbers are envisaged. Once moved into position the chemical being used is pumped into the carriage under pressure by conventional means. The pressure causes the telescopic probes to extend, pushing out into the material outside the bore through the corresponding pre-perforated holes (or holes made when the liner is in place) in the sacrificial liner. The quantity of chemical being delivered and the region to which it is delivered will be chosen for each instance based on the knowledge of the geology gained during the boring process and on the ultimate design strength of the tunnel required.

Figure 10:
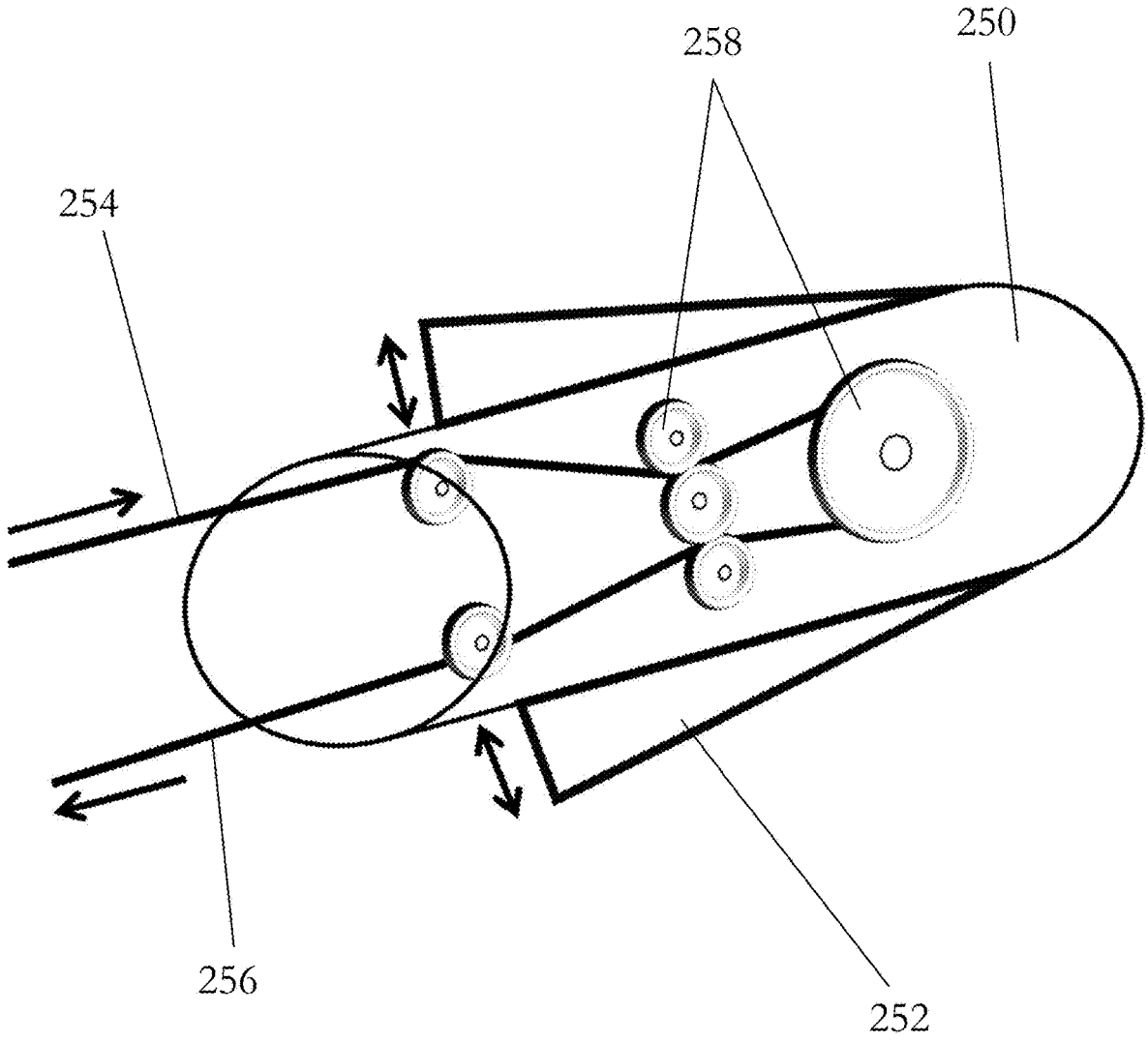
FIG. 10 is a view of a down hole cable return carriage.

FIG. 10 is a view of a down hole cable return carriage, shown with the carriage housing 250 as transparent. A clamping system 252 that engages with the walls of the lined bore into which it has been deployed is disposed on the housing 250. The clamping system 252 can be engaged or disengaged by an operator, to permit the carriage to be moved within the bore, and secured in place ready for winching. A first end of a cable 254 is connected to the shield. A second end of the cable 256 is attached to a winch. As the winch winds in the second end of the cable 256, a series of pulleys 258 within the carriage reverse direction of the cable so that the shield is pulled by the first end of the cable 254.

The invention claimed is:

1. A method of constructing an underground tunnel, the method comprising the steps of:

drilling a first bore along a first predetermined path through underlying geology, the first bore having a length of at least 25 m;

drilling a plurality of second bores along respective second predetermined paths through the underlying geology, each of the respective second predetermined paths being substantially parallel to the first predetermined path in order for the plurality of second bores alone, or a combination of the plurality of second bores and the first bore together, to define a substantially prism-shape region having a cross-section of a geometric shape along an entire length of the first and second bores, the geometric shape and a size of that shape being constant along the entire length;

lining any one of the first bore and the plurality of second bores with a liner, the liner having holes therein;

treating the underlying geology through the holes in specific pre-defined directions, in advance of excavating the material in order to increase efficiency of excavating the material; and excavating material within the substantially prism-shape region to form a tunnel.

2. The method of claim 1, wherein excavating material within the substantially prism-shape region to form a tunnel is carried out from a tunnelling shield, the tunnelling shield comprising a plurality of probes on a leading edge thereof, each probe of the plurality of probes aligned with a respective bore of the first bore and plurality of second bores, each probe equipped with optionally interchangeable tools that allows each probe to excavate from within the first and/or second bores.

3. The method of claim 2, wherein treating comprises hydraulic fracturing of the material within the substantially prism-shape region.

4. The method of claim 1, wherein treating comprises hydraulic fracturing of the material within the substantially prism-shape region.

5. The method of claim 1, wherein treating comprises stabilising the underlying geology outside the substantially prism-shape region.

* * * * *